US006705514B2

(12) United States Patent
Pellati

(10) Patent No.: US 6,705,514 B2
(45) Date of Patent: Mar. 16, 2004

(54) BROADSHEET FOR MANUFACTURING A CARTON AND CARTON MANUFACTURED FROM SUCH A BROADSHEET

(76) Inventor: Carlo Andrea Pellati, Jacob van Lennepstraat 335, 1053 JK Amsterdam (NL)

( * ) Notice: Subject to any disclaimer, the term of this patent is extended or adjusted under 35 U.S.C. 154(b) by 0 days.

(21) Appl. No.: 10/199,653

(22) Filed: Jul. 18, 2002

(65) Prior Publication Data

US 2003/0015580 A1 Jan. 23, 2003

(30) Foreign Application Priority Data

Jul. 19, 2001 (NL) ..... 1018579

(51) Int. Cl.[7] ..... B65D 5/487

(52) U.S. Cl. ..... 229/120.12; 229/116; 229/120.13; 229/120.18; 229/400; 229/904; 229/906

(58) Field of Search ..... 229/120.12, 120.13, 229/120.18, 400, 902, 904, 906, 120.23, 120.35, 116, 117, 4.5

(56) References Cited

U.S. PATENT DOCUMENTS

| | | | | |
|---|---|---|---|---|
| 2,569,733 A | * | 10/1951 | Ringler | 229/120.13 |
| 4,126,261 A | * | 11/1978 | Cook | 229/904 |
| 5,720,429 A | * | 2/1998 | Cordle | 229/120.18 |
| 5,842,631 A | * | 12/1998 | Berger | 229/120.13 |
| 6,102,208 A | | 8/2000 | Huang | |
| 6,119,930 A | * | 9/2000 | Lunstra et al. | 229/400 |
| 6,471,119 B2 | * | 10/2002 | Cai | 229/120.12 |
| 6,543,679 B2 | * | 4/2003 | Cai et al. | 229/906 |

FOREIGN PATENT DOCUMENTS

| | | | | |
|---|---|---|---|---|
| AU | 34024/93 B | * | 10/1993 | 229/904 |
| BE | 706266 | | 3/1968 | |
| DE | 614289 A | * | 6/1935 | 229/400 |
| DE | 8808196 | | 8/1988 | |
| GB | 2147275 A | * | 5/1985 | 229/4.5 |

* cited by examiner

*Primary Examiner*—Gary E. Elkins
(74) *Attorney, Agent, or Firm*—Westman, Champlin & Kelly, P.A.; S. Koehler

(57) ABSTRACT

A broadsheet for manufacturing a carton for foodstuffs, such as chips, is described, which container comprises a container and a subcontainer for a garnishing, such as mayonnaise. The broadsheet is composed of a primary sheet of material for forming a container and a secondary sheet of material connected thereto for forming a subcontainer. The primary sheet of material is substantially rectangular and, starting from a first corner point, includes at least two folding lines extending to the opposite corner point and to one of the two sides of the rectangle adjacent thereto, respectively, whilst the secondary sheet of material is connected to one of the sides via a folding line and, starting from one of the corner points adjacent to the side in question, extends substantially along half the length of the side. Furthermore, a carton manufactured from the broadsheet is disclosed.

10 Claims, 5 Drawing Sheets

BROADSHEET FOR MANUFACTURING A CARTON AND CARTON MANUFACTURED FROM SUCH A BROADSHEET

BACKGROUND OF THE INVENTION

The invention relates in the first place to a broadsheet for manufacturing a container for foodstuffs, such as chips, which container comprises a subcontainer for a garnishing, such as mayonnaise, which broadsheet is composed of a primary sheet of material for forming the container and a secondary sheet of material connected thereto for forming the subcontainer.

An embodiment of such a broadsheet is disclosed in U.S. Pat. No. 6,102,208. The broadsheet according to this document is mainly T-shaped. When a large number of such broadsheets are to be manufactured from a large sheet of material, a large amount of material is lost.

It is an object of the present invention to provide a broadsheet of the type referred to in the introduction, in which this drawback is eliminated in a simple but nevertheless efficient manner.

SUMMARY OF THE INVENTION

In order to accomplish that objective, the broadsheet according to the invention is characterized in that the primary sheet of material is substantially rectangular and, starting from a first corner point, includes at least two folding lines extending to the opposite corner point and to one of the two sides of the rectangle adjacent thereto, respectively, while the secondary sheet of material is connected to one of said sides via a folding line and, starting from one of the corner points adjacent to the side in question, extends substantially along half the length of said side.

As a result of the substantially rectangular shape of the primary sheet of material and the position of the secondary sheet of material relative to said primary sheet of material, and the dimension of the secondary sheet of material, two broadsheets, which are turned 180° relative to each other, can be positioned side by side in such a manner that together they form substantially a rectangle. In this way, a large number of broadsheets of the type according to the invention can be manufactured from a large sheet of material with a minimum loss of material.

It is noted that Belgian patent 706.266 shows a substantially rectangular broadsheet having an least two folding lines extending from a first corner point to the opposite corner point and to an adjacent side, respectively. A combination of this rectangular broadsheet with the broadsheet according to U.S. Pat. No. 6,102,208 does not provide the broadsheet according the invention as these prior art documents do not suggest anything regarding the specific location and dimension of the secondary sheet of material.

Starting from the basic idea of the invention, a number of possibilities are available for a further realization of the inventive concept. Thus, the broadsheet of a preferred embodiment is characterized in that the secondary sheet of material extends from the corner point that is located opposite said first corner point.

The effect that is achieved in this manner is that an optimum (readily accessible) position of the subcontainer is obtained in the position of use of the container.

Furthermore, the secondary sheet of material may include a folding line that extends in mirror reflection with the folding line of the primary sheet of material of the primary sheet of material that extends from the first corner point to the opposite corner point. The mirror reflection is with respect to to the folding line of the primary sheet and the secondary sheet of material. In the position of use of the container, said folding line extending in mirror reflection enables easy movement of the secondary sheet of material to a position in which the subcontainer is ready to receive the garnishing. During said movement, a dead point is passed, as it were.

Within this framework it is furthermore preferable for the primary sheet of material to be bevelled at the corner point that is located opposite said first corner point. In the position of use of the container, the bevel at the corner point enables easy engagement of the secondary sheet of material by a finger of a user at that location, thus making it possible to move the secondary sheet of material to the position of use with respect to the primary sheet of material.

According to a final possibility, the primary sheet of material forms a square. This is a special variant of the rectangular shape.

The invention also relates to a carton having a container for foodstuffs, such as chips, and a subcontainer for a garnishing, such as mayonnaise, both of which having been formed from a broadsheet according to the present invention.

BRIEF DESCRIPTION OF THE DRAWINGS

The invention will be explained in more detail hereinafter with reference to the drawing, which shows an embodiment of a broadsheet according to the invention and the container manufactured therefrom.

DETAILED DESCRIPTION OF A PREFERRED EMBODIMENT

Figure 1:
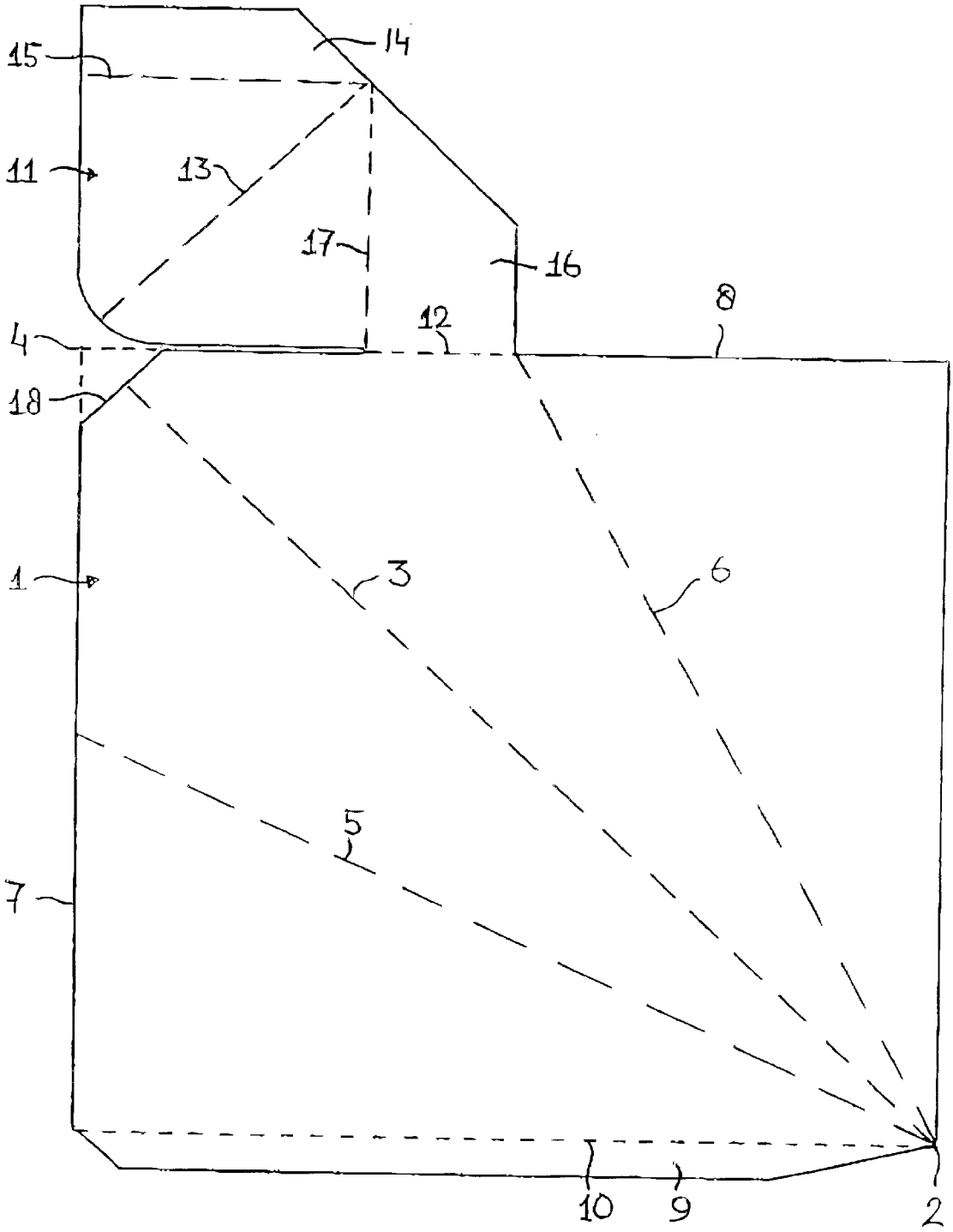
FIG. 1 shows an embodiment of the broadsheet according to the invention.
Figure 7:
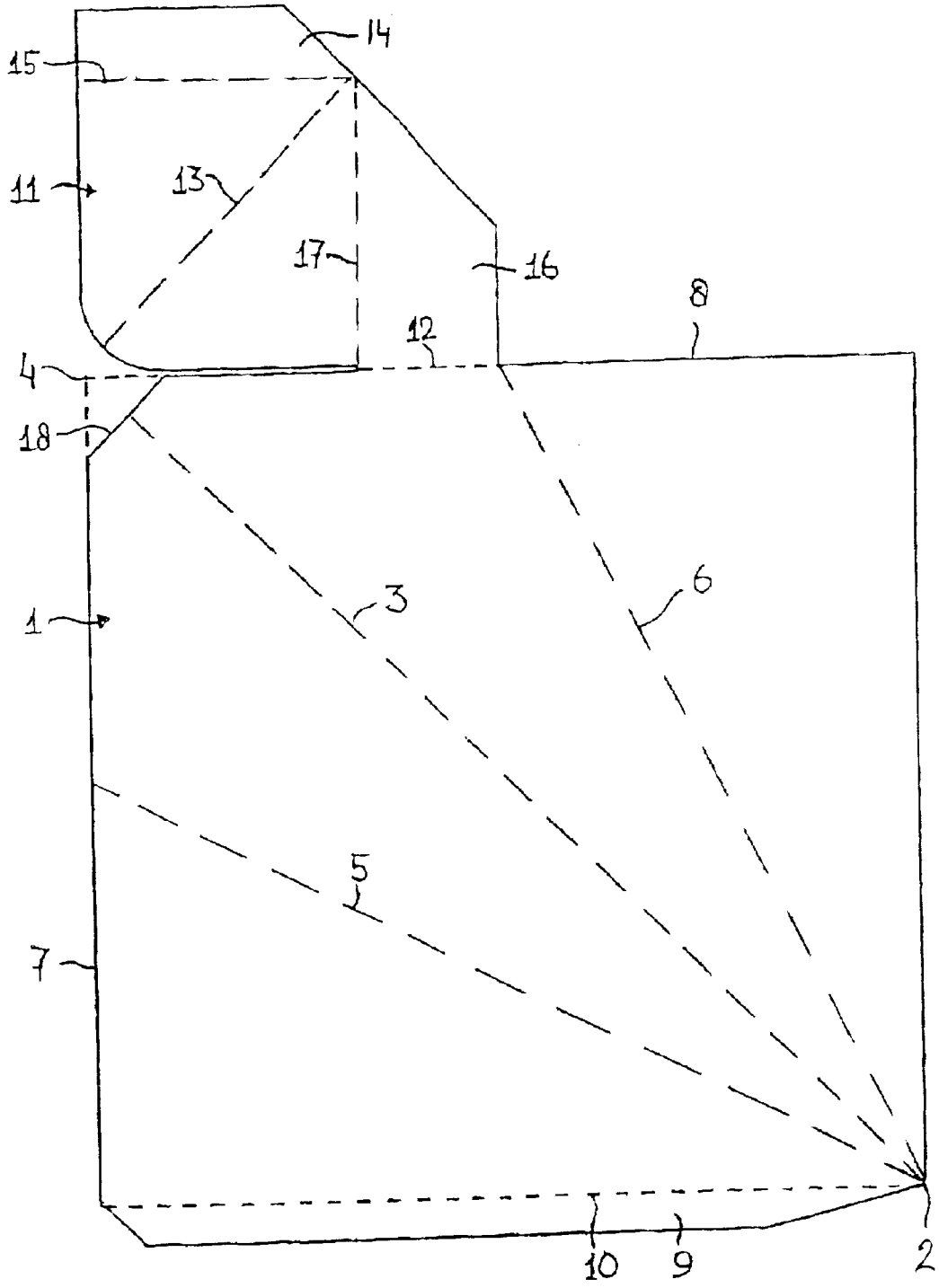
FIG. 7 shows another embodiment of the broadsheet according to the invention.

The broadsheet that is shown in FIG. 1 comprises a substantially rectangular or, in a special case as illustrated in FIG. 7, a square primary sheet of material 1. A folding line 3 extends from a first corner point 2 to an opposite corner point 4, whilst folding lines 5 and 6 likewise extend from said first corner point 2, to the sides 7 and 8 adjacent to the corner point 4. In the illustrated embodiment, the folding lines 5 and 6 terminate in the centres of the sides 7 and 8, respectively. Furthermore, an adhesive strip 9 is shown, which is connected to the primary sheet of material 1 via a folding line 10. Other forms of connection and/or fastening may be used in place of adhesive strip 9. Such forms include tape, slot/tab combinations, glue and other fasteners.

In principle it would suffice to use only the folding lines 3 and 10. A larger number of folding lines (preferably an even number) is also possible, however.

Associated with the illustrated broadsheet is furthermore a secondary sheet of material 11, which is connected to the primary sheet of material 1 via a folding line 12. Starting from the corner point 4, the secondary sheet of material 11 extends substantially along half the length of the side 8.

The secondary sheet of material 11 includes a folding line 13 which extends in mirror reflection with respect to the folding line 3, with the folding line 12 between the primary sheet of material 1 and the secondary sheet of material 11 as the dividing line.

The secondary sheet of material 11 includes an adhesive strip 14, which joins the sheet of material via a folding line 5, as well as an adhesive strip 16, which joins the sheet of material via a folding line 17 and which effects the connection to the primary sheet of material 1 via the folding line 12. The function of said adhesive strips 14 and 16 will be explained in more detail hereinafter. Other forms of connection and/or fasteners may be used in place of adhesive strips 14 and 16. Such forms include tape, slot/tab combinations, glue and other fasteners. Finally it appears from FIG. 1 that the primary sheet of material comprises a bevel 18 at its corner point 4 (the corner point 4 is an imaginary corner point in that case). The function of said bevel 18 will become apparent later.

Figure 2:
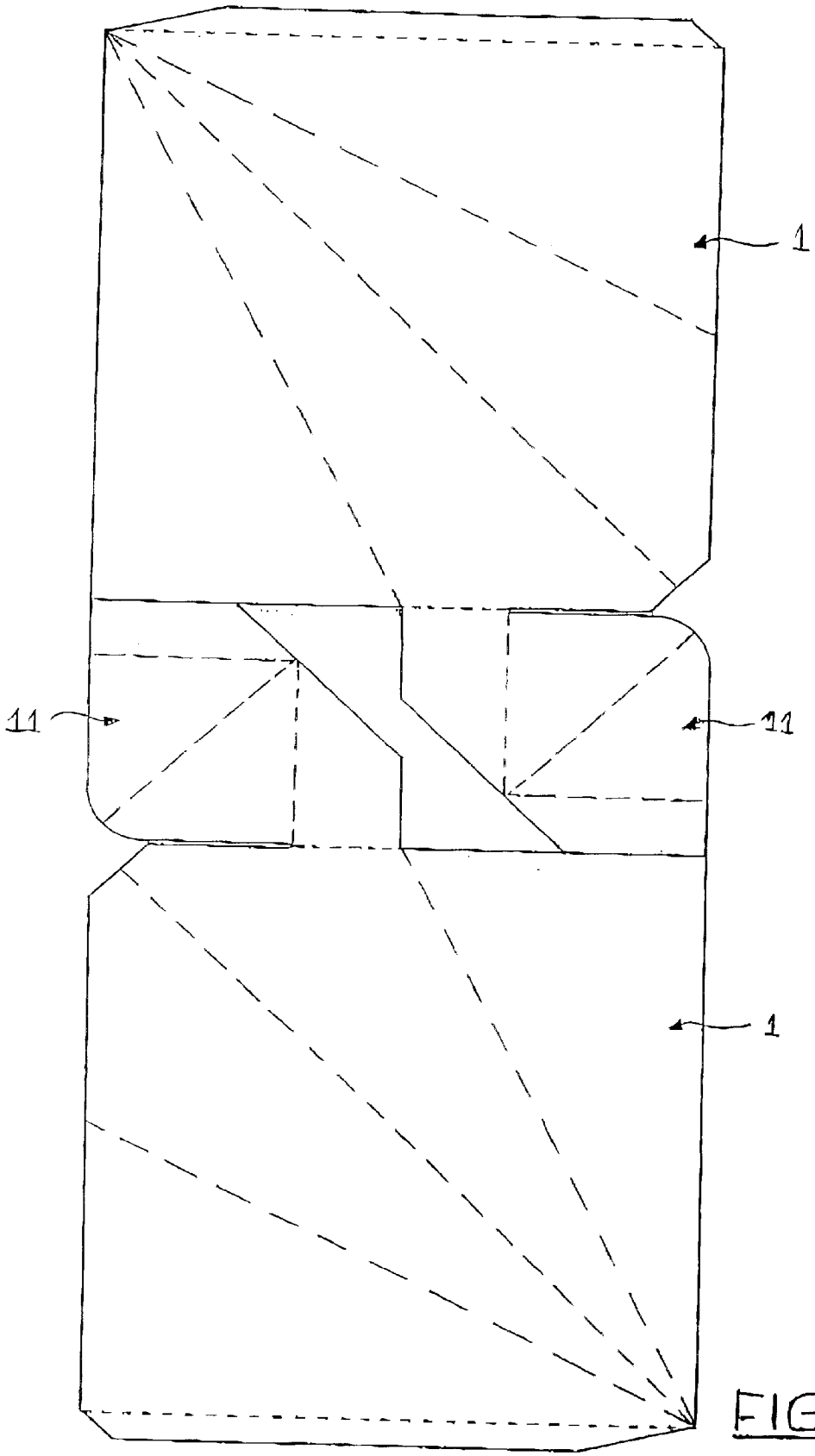
FIG. 2 is a view at a smaller scale of two adjoining broadsheets of the type that is shown in FIG. 1.

FIG. 2 shows, on a smaller scale, two identical broadsheets according to FIG. 1, which are arranged side by side. As is apparent from the figure, the shape of the broadsheets is such that, when combined, they form a rectangle again, with only a minimum loss of material. Of course it is possible to combine more than two broadsheets, so that broadsheets according to the present invention can be cut from a large sheet of material with a minimum loss of material.

The forming of a carton from the broadsheet that is shown in FIG. 1 will now be explained with reference to FIGS. 3–6.

Figure 3:
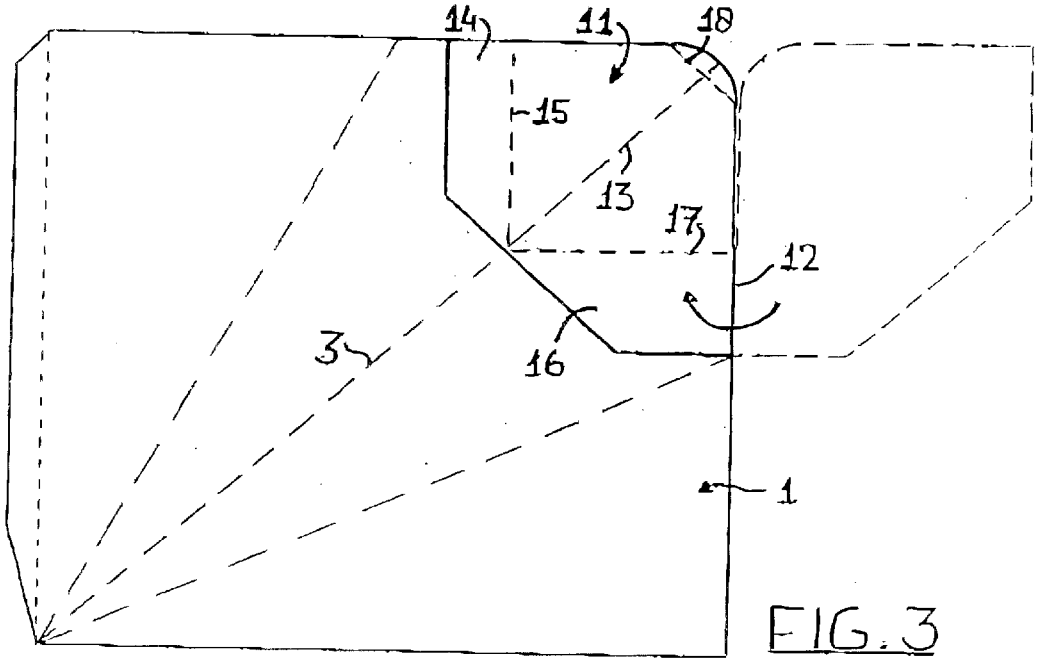
FIGS. 3–6 show successive stages of the manufacture of a carton from the broadsheet of FIG. 1.

FIG. 3 shows the first step, in which the secondary sheet of material 11 is folded about the folding line 12 into abutment with the primary sheet of material 1. Following this, the secondary sheet of material 11 is affixed to the primary sheet of material 1 by means of the adhesive strips 14 and 16. In the position that is shown in FIG. 3, the folding line 13 of the secondary sheet of material 11 and the folding line 3 of the primary sheet of material 1 coincide. Furthermore it is apparent that the secondary sheet of material 11 projects with respect to the primary sheet of material 1 at the corner point 4 of said primary sheet of material 1, due to the bevel 18 that has been formed at that point.

Figure 4:
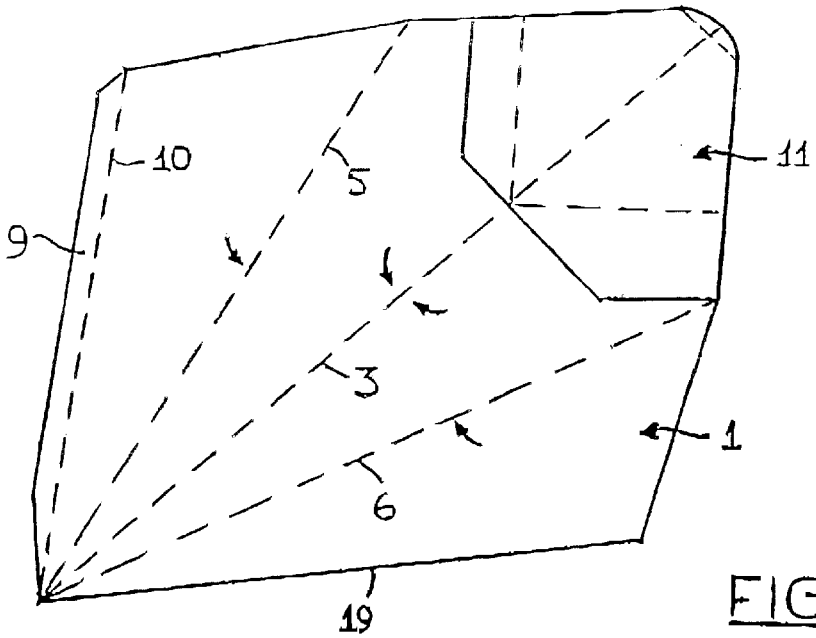
Figure 6:
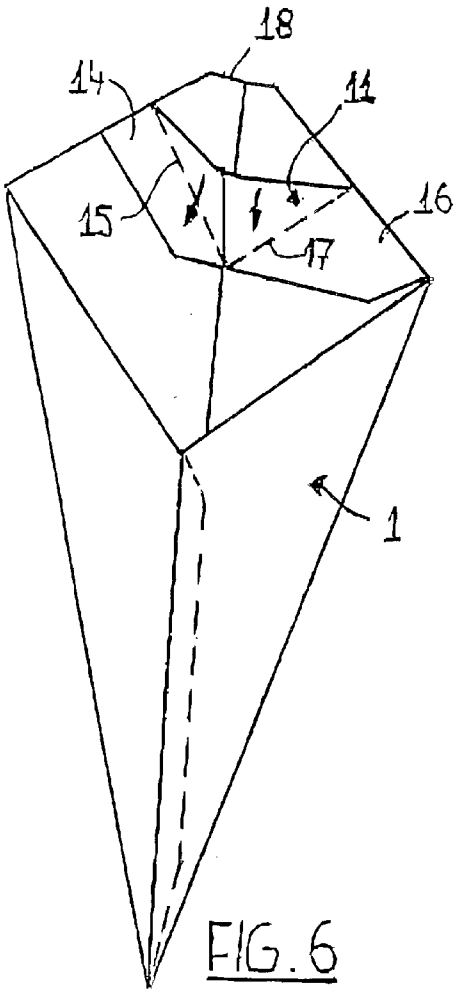
Figure 5:
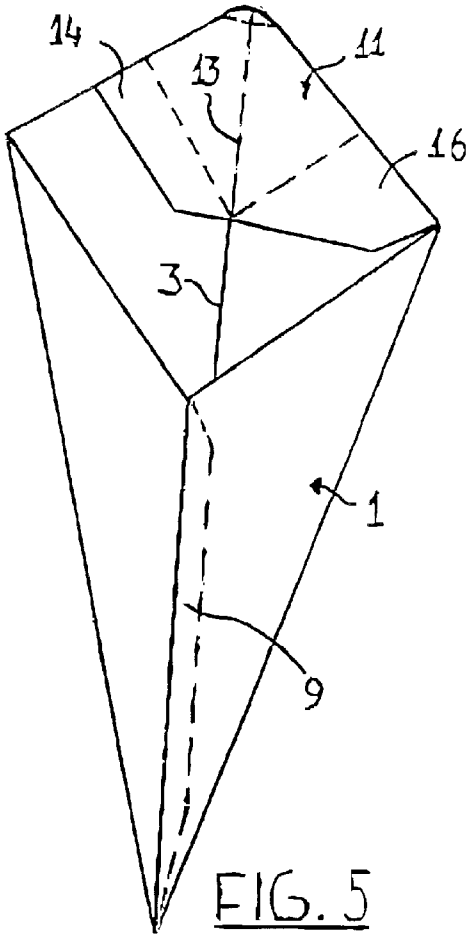

Starting from the situation that has been reached in FIG. 3, the primary sheet of material 1 is folded together about its folding lines 3, 5 and 6, until the adhesive strip 9 can be affixed to the side 19 of the primary sheet of material 1 (see FIG. 4). The container is thus given the configuration that is shown in FIG. 5.

Finally, the secondary sheet of material 11 is folded inwardly about its folding lines 15 and 17 (see FIG. 6) by engaging the part thereof that projects beyond the bevel 18 of the primary sheet of material 1 with a finger. During said folding, a dead point is passed, so that the secondary sheet of material 11 is maintained in the inwardly folded position in a reliable manner. In this position, said sheet forms a subcontainer for a garnishing, such as mayonnaise, whilst the main container that is formed by the primary sheet of material 1 is intended for foodstuffs, such as chips.

The invention is not limited to the embodiments as described in the foregoing, which can be varied in many ways within the scope of the invention as defined in the claims.

What is claimed is:

1. A broadsheet for manufacturing a carton for foodstuffs, which carton includes a container and a subcontainer the broadsheet comprising a primary sheet of material for forming the container and a secondary sheet of material connected thereto for forming the subcontainer, wherein the primary sheet of material is substantially rectangular and, starting from a first corner point, includes at least two folding lines extending to an opposite corner point and to one of two sides forming the opposite corner, wherein the secondary sheet of material is connected to said one of said two sides via a folding line and, starting from one of the corner points adjacent to said one of said two sides, extends substantially along half the length of said one of said two sides.

2. The broadsheet according to claim 1, wherein the secondary sheet of material extends from the corner point that is located opposite said first corner point.

3. The broadsheet according to claim 2, wherein the secondary sheet of material includes a folding line that extends in mirror reflection with the folding line of the primary sheet of material that extends from the first corner point to the opposite corner point, said mirror reflection being with respect to said one of said two sides.

4. The broadsheet according to claim 3, wherein the primary sheet of material is bevelled at a corner point located opposite said first corner point.

5. The broadsheet according to claim 1, wherein an overall length and an overall width of said primary sheet of material are approximately equal.

6. A carton for foodstuff having a container and a subcontainer the carton comprising a broadsheet comprising a primary sheet of material for forming the container and a secondary sheet of material connected thereto for forming the subcontainer, wherein the primary sheet of material is substantially rectangular and, starting from a first corner point, includes at least two folding lines extending to an opposite corner point and to one of two sides forming the opposite corner, wherein the secondary sheet of material is connected to one of said two sides via a folding line and, starting from one of the corner points adjacent to said one of said two sides, extends substantially along half the length of said one of said two sides; and means for holding portions of the broadsheet adjacent to each other to form the container and the subcontainer.

7. The carton according to claim 6, wherein the secondary sheet of material extends from the corner point that is located opposite said first corner point.

8. The carton according to claim 7, wherein the secondary sheet of material includes a folding line that extends in mirror reflection with the folding line of the primary sheet of material that extends from the first corner point to the opposite corner point, said mirror reflection being with respect to said one of said two.

9. The carton according to claim 8, wherein the primary sheet of material is bevelled at a corner point located opposite said first corner point.

10. The carton according to claim 6, wherein an overall length and an overall width of said primary sheet of material are approximately equal.

* * * * *